US010800180B2

(12) United States Patent
Yoshida

(10) Patent No.: US 10,800,180 B2
(45) Date of Patent: Oct. 13, 2020

(54) LIQUID CIRCULATION DEVICE AND LIQUID DISCHARGE APPARATUS

(71) Applicant: Ryuji Yoshida, Kanagawa (JP)

(72) Inventor: Ryuji Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/443,097

(22) Filed: Jun. 17, 2019

(65) Prior Publication Data

US 2019/0381803 A1 Dec. 19, 2019

(30) Foreign Application Priority Data

Jun. 19, 2018 (JP) ..... 2018-116040

(51) Int. Cl.
*B41J 2/18* (2006.01)

(52) U.S. Cl.
CPC ..... *B41J 2/18* (2013.01)

(58) Field of Classification Search
CPC ..... B41J 2/18
USPC ..... 347/89
See application file for complete search history.

(56) References Cited

U.S. PATENT DOCUMENTS

2010/0259587 A1* 10/2010 Uptergrove ..... B41J 2/18 347/85
2012/0007918 A1* 1/2012 Ohtsu ..... B41J 2/14201 347/45
2018/0194135 A1 7/2018 Iwama et al.
2018/0272740 A1 9/2018 Otome et al.

FOREIGN PATENT DOCUMENTS

JP 2013-166308 8/2013
JP 2014-141032 8/2014
JP 2017-001342 1/2017

* cited by examiner

*Primary Examiner* — Huan H Tran
*Assistant Examiner* — Alexander D Shenderov
(74) *Attorney, Agent, or Firm* — Duft & Bornsen, PC

(57) ABSTRACT

A liquid circulation device includes a first liquid discharge head to discharge a liquid, a first supply channel to supply the liquid to the first liquid discharge head, a first collection channel to collect the liquid from the first liquid discharge head, a second liquid discharge head to discharge the liquid and disposed higher than the first liquid discharge head, a second supply channel to supply the liquid to the second liquid discharge head, a second collection channel to collect the liquid from the second liquid discharge head, a supply-side fluid restrictor disposed in the first supply channel to make a fluid resistance value of the first supply channel greater than a fluid resistance value of the second supply channel, and a collection-side fluid restrictor disposed in the second collection channel to make a fluid resistance value of the second collection channel greater than a fluid resistance value of the first collection channel.

20 Claims, 13 Drawing Sheets

LIQUID CIRCULATION DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-116040, filed on Jun. 19, 2018 in the Japan Patent Office, the entire disclosure of which is hereby incorporated by reference herein.

BACKGROUND

Technical Field

The present disclosure relates to a liquid circulation device and a liquid discharge apparatus incorporating the liquid circulation device.

Related Art

A liquid discharge head (also simply referred to as a "head") includes a plurality of supply channels connected to a plurality of pressure chambers (individual chambers), and a plurality of collection channels connected to the plurality of pressure chambers (individual chambers). The plurality of pressure chambers (individual chambers) is connected to a plurality of nozzles. A flow-through type (circulation-type) head includes a liquid supply port connected to the plurality of supply channels and a liquid collection port connected to the plurality of collection channels.

In contrast, a liquid circulation device includes a plurality of heads arranged side by side with respect to a supply-side common channel and a collection-side common channel. The liquid circulation device detects and adjusts pressure in each of the supply-side common channel and the collection-side common channel.

SUMMARY

In an aspect of this disclosure, a novel liquid circulation device includes a first liquid discharge head to discharge a liquid, a first supply channel to supply the liquid to the first liquid discharge head, a first collection channel to collect the liquid from the first liquid discharge head, a second liquid discharge head to discharge the liquid and disposed higher than the first liquid discharge head, a second supply channel to supply the liquid to the second liquid discharge head, a second collection channel to collect the liquid from the second liquid discharge head, a supply-side fluid restrictor disposed in the first supply channel to make a fluid resistance value of the first supply channel greater than a fluid resistance value of the second supply channel, and a collection-side fluid restrictor disposed in the second collection channel to make a fluid resistance value of the second collection channel greater than a fluid resistance value of the first collection channel.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
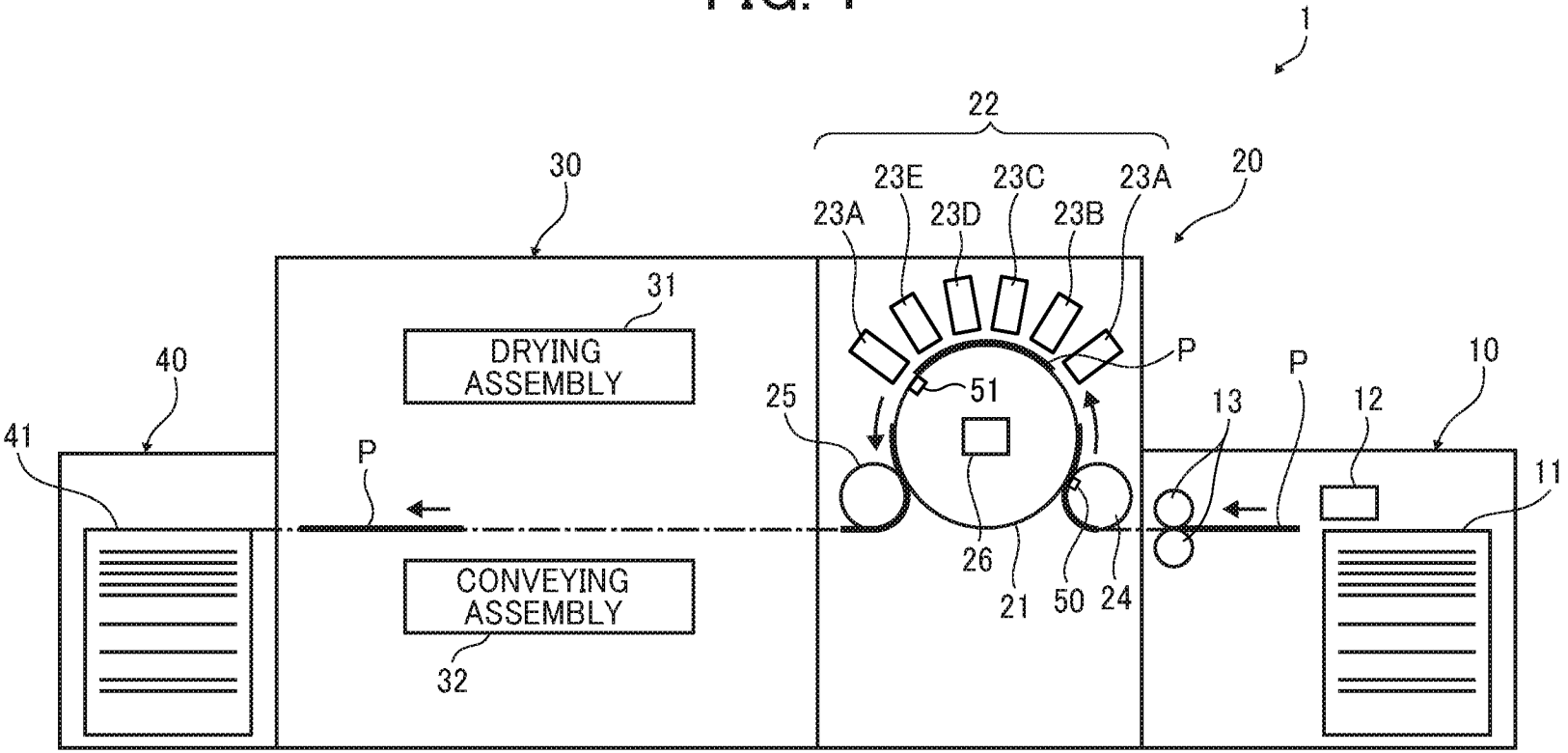
FIG. 1 is a schematic side view of a liquid discharge apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, exemplary embodiments of the present disclosure are described below. A first embodiment of the present disclosure is described with reference to FIG. 1. FIG. 1 is a schematic side view of a printing apparatus 1 according to a first embodiment of the present disclosure.

The printing apparatus 1 includes a loading unit 10, a printing unit 20, a drying unit 30, and an ejection unit 40. The printing apparatus 1 applies a liquid to a sheet P (sheet-like member) conveyed from the loading unit 10 by the printing unit 20 to perform required printing. The printing apparatus 1 further dries the liquid adhered to the sheet P by the drying unit 30, and ejects the sheet P to the ejection unit 40.

The loading unit 10 includes a loading tray 11 on which a plurality of sheets P is stacked, a feeder 12 to separate and to feed the sheets P one by one from the loading tray 11, and a resist roller pair 13 to feed the sheets P to the printing unit 20.

Any feeder, such as a device using a roller or a device using air suction, may be used as the feeder 12. The sheet P delivered from the loading tray 11 by the feeder 12 is delivered to the printing unit 20 by the resist roller pair 13 being driven at a predetermined timing after a leading edge of the sheet P reaches the resist roller pair 13.

The printing unit 20 includes a carrying drum 21 to carry and convey the sheet P on an outer peripheral surface of the carrying drum 21 and a liquid discharge device 22 that discharges the liquid toward the sheet P carried on the carrying drum 21 to apply the liquid to the sheet P. The carrying drum 21 functions as a first rotator.

The printing unit 20 further includes a transfer cylinder 24 that receives the fed sheet P and transfers the sheet P to the carrying drum 21 and a delivery cylinder 25 that delivers the sheet P conveyed by the carrying drum 21 to the drying unit 30. The transfer cylinder 24 functions as a second rotator.

A leading end of the sheet P conveyed from the loading unit 10 to the printing unit 20 is gripped by a second gripper 50 (sheet gripper) provided on a surface of the transfer cylinder 24 and is conveyed with the rotation of the transfer cylinder 24. A specific configuration of the second gripper 50 is described below. The sheet P conveyed by the transfer cylinder 24 is delivered to the carrying drum 21 at a position facing the carrying drum 21.

A first gripper 51 (sheet gripper) is also provided on the surface of the carrying drum 21, and the leading end of the sheet P is gripped by the first gripper 51 (sheet gripper). A plurality of suction holes is dispersed over the surface of the carrying drum 21. A suction unit 26 generates a suction airflow from the suction port of the carrying drum 21 toward the interior of the carrying drum 21 as a suction stage.

Then, the leading end of the sheet P delivered from the transfer cylinder 24 to the carrying drum 21 is gripped by the first gripper 51 (sheet gripper) of the carrying drum 21, attracted by the suction airflow to the surface of the carrying drum 21 by the suction unit 26, and conveyed to the delivery cylinder 25 as the carrying drum 21 rotates.

The liquid discharge device 22 includes discharge units 23 (23A to 23F) to discharge liquids of a specific color, for example, yellow (Y), cyan (C), magenta (M), and black (K). For example, the discharge unit 23A discharges a liquid of cyan (C), the discharge unit 23B discharges a liquid of magenta (M), the discharge unit 23C discharges a liquid of yellow (Y), and the discharge unit 23D discharges a liquid of black (K), respectively. Further, the discharge units 23E and 23F are used to discharge any one of YMCK or a special liquid such as white and gold (silver). Further, the liquid discharge device 22 may further include a discharge unit to discharge a processing liquid such as a surface coating liquid.

A discharge operation of each of the discharge units 23 of the liquid discharge device 22 is controlled by drive signals corresponding to print information. When the sheet P carried by the carrying drum 21 passes through a region facing the liquid discharge device 22, liquid of each color is discharged from the discharge units 23, and an image corresponding to the printing information is printed on the sheet P.

The drying unit 30 includes a drying assembly 31 to dry the liquid adhered on the sheet P by the printing unit 20 and a conveying assembly 32 to convey (attract and convey) the sheet P while attracting the sheet P conveyed from the printing unit 20.

After the sheet P conveyed from the printing unit 20 is received by a conveying assembly 32, the sheet P is conveyed to pass through the drying assembly 31 and delivered to the ejection unit 40.

When the sheet P passes through the drying assembly 31, the liquid on the sheet P is subjected to a drying process. Thus, the liquid component such as water in the liquid evaporates, the colorant contained in the liquid is fixed on the sheet P, and curling of the sheet P is reduced.

The ejection unit 40 includes an ejection tray 41 on which a plurality of sheets P is stacked. The plurality of sheets P conveyed from the drying unit 30 is sequentially stacked and held on the ejection tray 41.

The printing apparatus 1 may include a pre-processing unit that performs pre-processing on the sheet P upstream of the printing unit 20, for example. Further, the printing apparatus 1 may include a post-processing unit that performs post-processing on the sheet P, to which the liquid is adhered, between the drying unit 30 and the ejection unit 40.

For example, the pre-processing unit may perform pre-processing that applies a treatment liquid on the sheet P before the image formation. The treatment liquid reacts with the liquid (ink) on the sheet P to reduce bleeding of the liquid onto the sheet P. However, the content of the pre-processing is not particularly limited to the process described above. Further, the post-processing unit may perform a sheet reversing process and a binding process to bind a plurality of sheets P together, for example. The sheet reversing process reverses the sheet P, on which an image is printed by the printing unit 20, and conveys the reversed sheet P again to the printing unit 20 to print on both sides of the sheet P.

Figure 2:
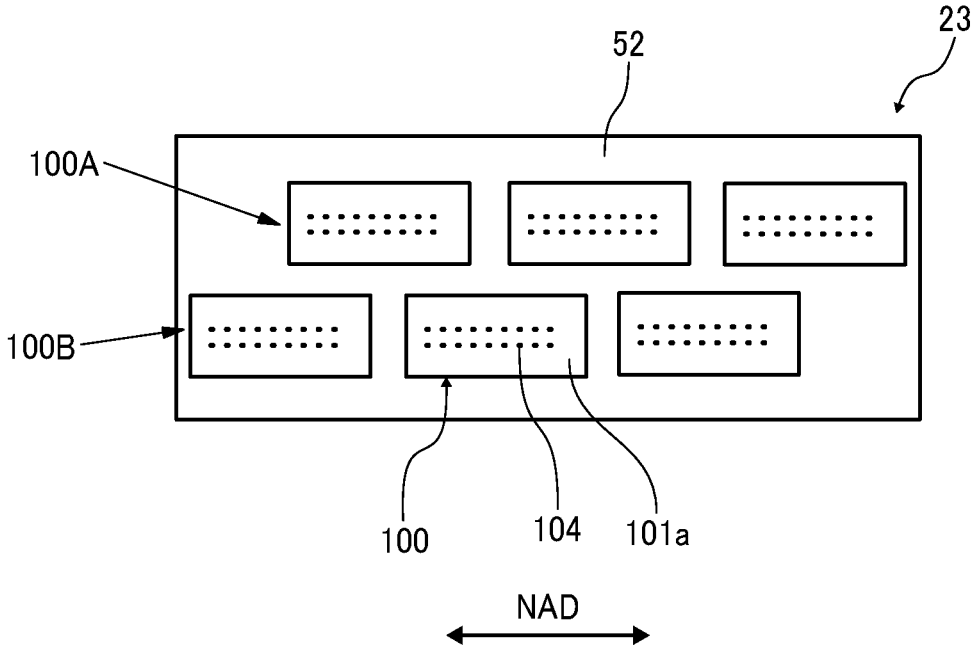
FIG. 2 is a plan view of a head unit of the liquid discharge apparatus of FIG. 1.
Figure 3:
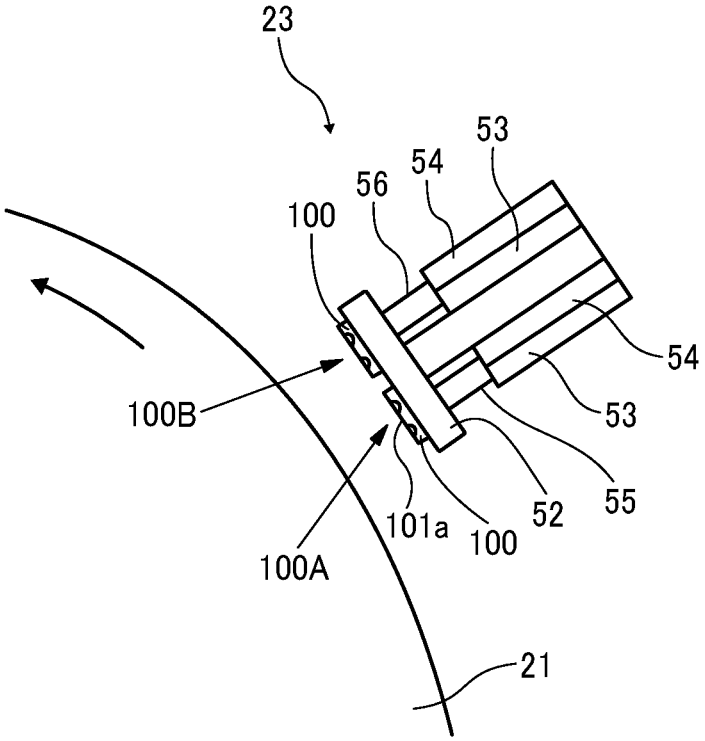
FIG. 3 is a side view of one discharge unit disposed adjacent a carrying drum.

Next, an example of the discharge unit 23 of the printing apparatus 1 is described with reference to FIGS. 2 and 3. FIG. 2 is a plan view of the discharge unit 23. FIG. 3 is a side view of one discharge unit disposed adjacent the carrying drum 21.

The discharge unit 23 is a full-line type head unit that includes a plurality of circulation-type heads 100 arranged in a staggered manner on a base 52. Each of the plurality of heads 100 includes one or more nozzle arrays in which a plurality of nozzles 104 is arrayed on a nozzle face 101*a* of the each of the heads 100.

Each head 100 of the discharge unit 23 includes a supply-side head tank 53 and a collection-side head tank 54 to store the liquid to be supplied to each of the heads 100. The supply-side head tank 53 and the collection-side head tank 54 are connected to the heads 100 via channels 55 and 56, respectively.

Here, an array of heads 100 in a nozzle array direction indicated by arrow NAD in FIG. 2 is referred to as a head array 100A. Another array of the heads 100 in the nozzle array direction NAD is referred to as a head array 100B.

When the discharge unit 23 is disposed adjacent the carrying drum 21, the nozzle face 101*a* of the discharge unit 23 is inclined to a horizontal direction as illustrated in FIG. 3.

Thus, as illustrated in FIG. 3, each head 100 of the head array 100B is disposed at a higher position than each head 100 of the head array 100A, for example. Thus, a height of the nozzle face 101*a* of each of the heads 100 of the head array 100B and a height of the nozzle face 101*a* of each of the heads 100 of the head array 100A are different. That is, each head 100 of the head arrays 100A and 100B is arranged such that the nozzle face 101*a* of each of the heads 100 of the head array 100B is higher than the nozzle face 101*a* of each of the heads 100 of the head array 100A.

Figure 4:
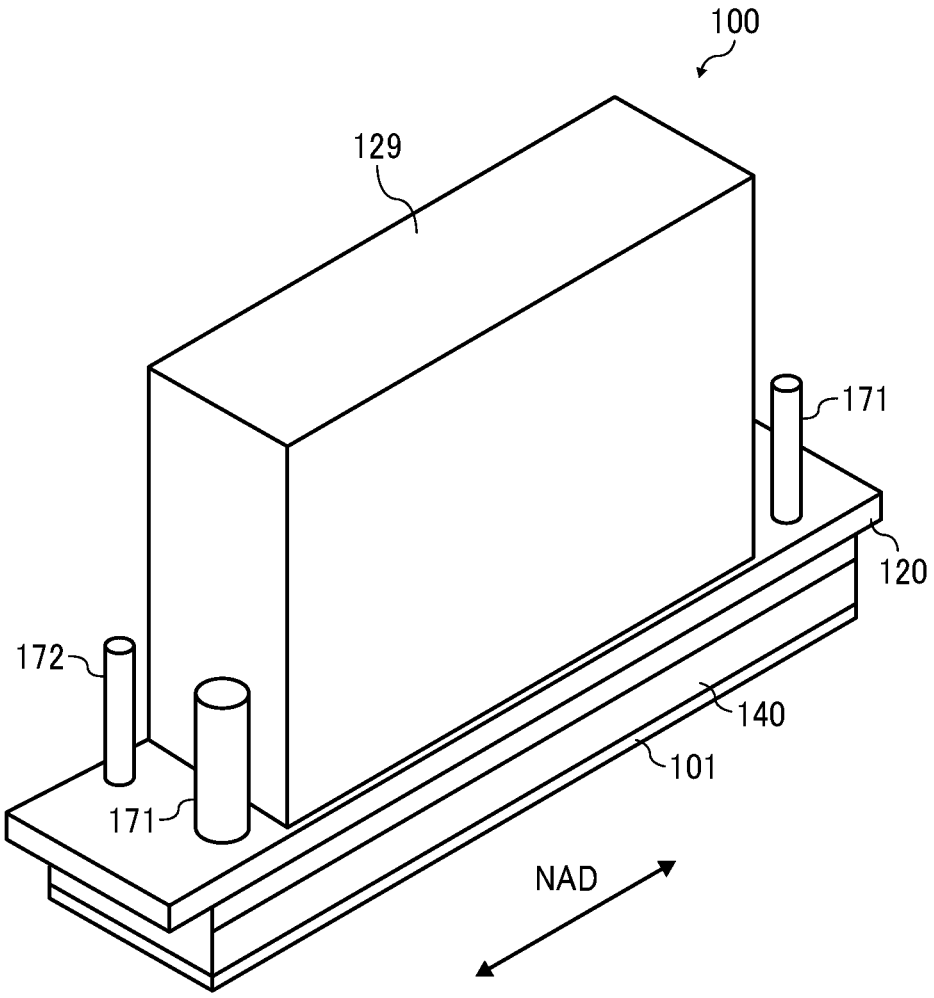
FIG. 4 is an external perspective view of an example of a circulation-type liquid discharge head.
Figure 5:
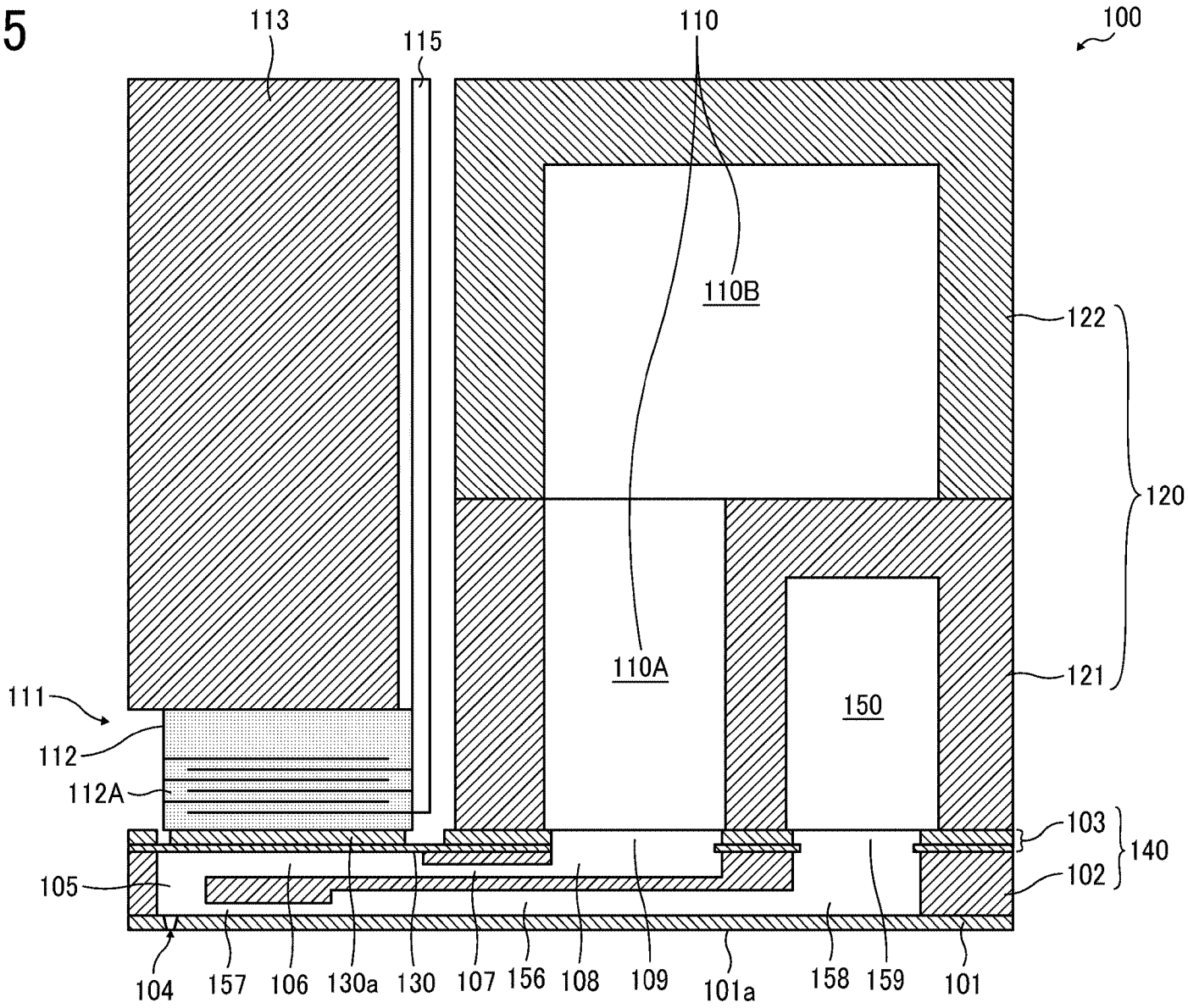
FIG. 5 is a cross-sectional view of the liquid discharge head of FIG. 4 in a transverse direction perpendicular to the nozzle array direction in which nozzles are arrayed in a row.

Next, an example of the head 100 of a circulation-type is described with reference to FIGS. 4 and 5. FIG. 4 is an outer perspective view of the head 100 according to the present disclosure. FIG. 5 is a cross-sectional view of the head 100 of FIG. 4 in a transverse direction perpendicular to the nozzle array direction NAD in which nozzles 104 are arrayed in a row. The transverse direction is along a longitudinal direction of the pressure chamber 106 (individual chamber).

The head 100 is a flow-through type head. The head 100 includes a nozzle plate 101, a channel plate 102, and a diaphragm 103 laminated one on another and bonded to each other. The diaphragm 103 functions as one wall of the pressure chamber 106 (individual chamber). The head 100 further includes a piezoelectric actuator 111, a common channel 120, and a cover 129. The piezoelectric actuator 111 displaces a vibration portion 130 of the diaphragm 103. The common channel 120 serves as a frame of the head 100. A portion of the head 100 formed by the channel plate 102 and the diaphragm 103 is referred to as a channel member 140.

The nozzle plate 101 includes a plurality of nozzles 104 to discharge a liquid.

The channel plate 102 includes pressure chambers 106 (individual chambers), supply-side fluid restriction part 107, and supply-side inlets 108. The pressure chambers 106 communicate with the nozzles 104 via nozzle communication channels 105, respectively. The supply-side fluid restriction part 107 communicate with the pressure chambers 106 (individual chambers), respectively. The supply-side inlets 108 communicate with the supply-side fluid restriction part 107, respectively. The nozzle communication channels 105 are channels to communicate with the nozzles 104 and the pressure chambers 106, respectively. The supply-side inlets 108 communicate with the supply-side common channel 110 through a supply-side opening 109 formed in the diaphragm 103.

The diaphragm 103 includes the deformable vibration portion 130 that forms one wall of the pressure chamber 106 (individual chambers) of the channel plate 102. Here, the diaphragm 103 has a two-layer structure (although the diaphragm 130 is not limited to the two-layer structure) and includes a first layer forming a thin portion from the channel plate 102 side and a second layer forming a thick portion. The first layer of the diaphragm 103 includes the deformable vibration portion 130 positioned corresponding to the pressure chambers 106 (individual chamber).

The piezoelectric actuators 111 including electromechanical transducer elements as driving devices (actuator devices or pressure generators) to deform the vibration portions 130 of the diaphragm 103 are disposed at a first side of the diaphragm 103 opposite a second side facing the pressure chambers 106 (individual chambers).

The piezoelectric actuator 111 includes piezoelectric members 112 bonded on a base 113. The piezoelectric members 112 are groove-processed by half cut dicing so that each piezoelectric member 112 includes a desired number of pillar-shaped piezoelectric elements 112A that are arranged in certain intervals to have a comb shape.

The piezoelectric element 112A is bonded to a projection portion 130*a*. The projection portion 130*a* is an island-shaped thick portion on the vibration portion 130 of the diaphragm 103. Further, a flexible wiring member 115 is connected to the piezoelectric element 112A.

The common channel 120 forms a supply-side common channel 110 and a collection-side common channel 150. The supply-side common channel 110 communicates with the supply port 171, and the collection-side common channel 150 communicates with the collection port 172.

In the present disclosure as illustrated in FIG. 5, the common channel 120 includes a first common channel 121 and a second common channel 122. The first common channel 121 is bonded to the diaphragm 103 of the channel member 140. The second common channel 122 is laminated on and bonded to the first common channel 121.

The first common channel 121 includes a downstream-side common channel 110A and a collection-side common channel 150. The downstream-side common channel 110A is a part of the supply-side common channel 110 to communicate with the supply-side inlet 108. The collection-side common channel 150 communicates with the collection-side individual channel 156. Further, the second common channel 122 forms an upstream-side common channel 110B that is a remaining part of the supply-side common channel 110.

The channel plate 102 includes collection-side fluid restriction part 157, collection-side individual channels 156, and collection-side outlets 158. The collection-side fluid restriction part 157 communicate with the pressure chambers 106 (individual chambers) via the nozzle communication channels 105, respectively.

The collection-side outlets 158 communicate with the collection-side common channel 150 through collection-side openings 159, respectively, formed in the diaphragm 103.

In the head 100 according to the present disclosure, the supply-side common channel 110, the supply-side opening 109, the supply-side inlet 108, and the supply-side fluid restriction part 107 constitute a supply channel. Further, the collection-side fluid restriction part 157, the collection-side individual channel 156, the collection-side outlet 158, and the collection-side opening 159 constitute a collection channel.

In the head 100, for example, when the voltage applied to the piezoelectric element 112A is lowered from a reference potential (intermediate potential), the piezoelectric element 12A contracts. As a result, the vibration portion 130 of the diaphragm 103 is pulled and the volume of the pressure chambers 106 increases, thus causing liquid to flow into the pressure chambers 106.

When the voltage applied to the piezoelectric element 112A is raised, the piezoelectric element 112A expands in a direction of lamination of the piezoelectric element 112A. The vibration portion 130 of the diaphragm 103 deforms in a direction toward the nozzle 104 and contracts the volume of the pressure chambers 106. As a result, the liquid in the pressure chambers 106 is squeezed out of the nozzle 104.

Liquid not discharged from the nozzles 104 passes the nozzles 104, and is supplied from the collection-side fluid restriction part 157, the collection-side individual channel 156, the collection-side outlet 158, and the collection-side opening 159 to the collection-side common channel 150. Then, the liquid is supplied from the collection-side common channel 150 to the supply-side common channel 110 again through an external circulation route.

Further, even when a liquid discharge operation to discharge the liquid from the nozzle 104 is not performed, the liquid is supplied from the supply-side common channel 110 to the collection-side common channel 150 through the supply-side opening 109, the supply-side inlet 108, the supply-side fluid restriction part 107, the pressure chamber 106, the collection-side fluid restriction part 157, the collection-side individual channel 156, the collection-side outlet 158, and the collection-side opening 159. Then, the liquid is supplied from the collection-side common channel 150 to the supply-side common channel 110 again through an external circulation route.

The drive method of the head is not limited to the above-described method (i.e., pull-push discharging). The way of discharging changes depending on how a drive waveform is applied. For example, pull discharging alone or push discharging alone is possible.

Figure 6:
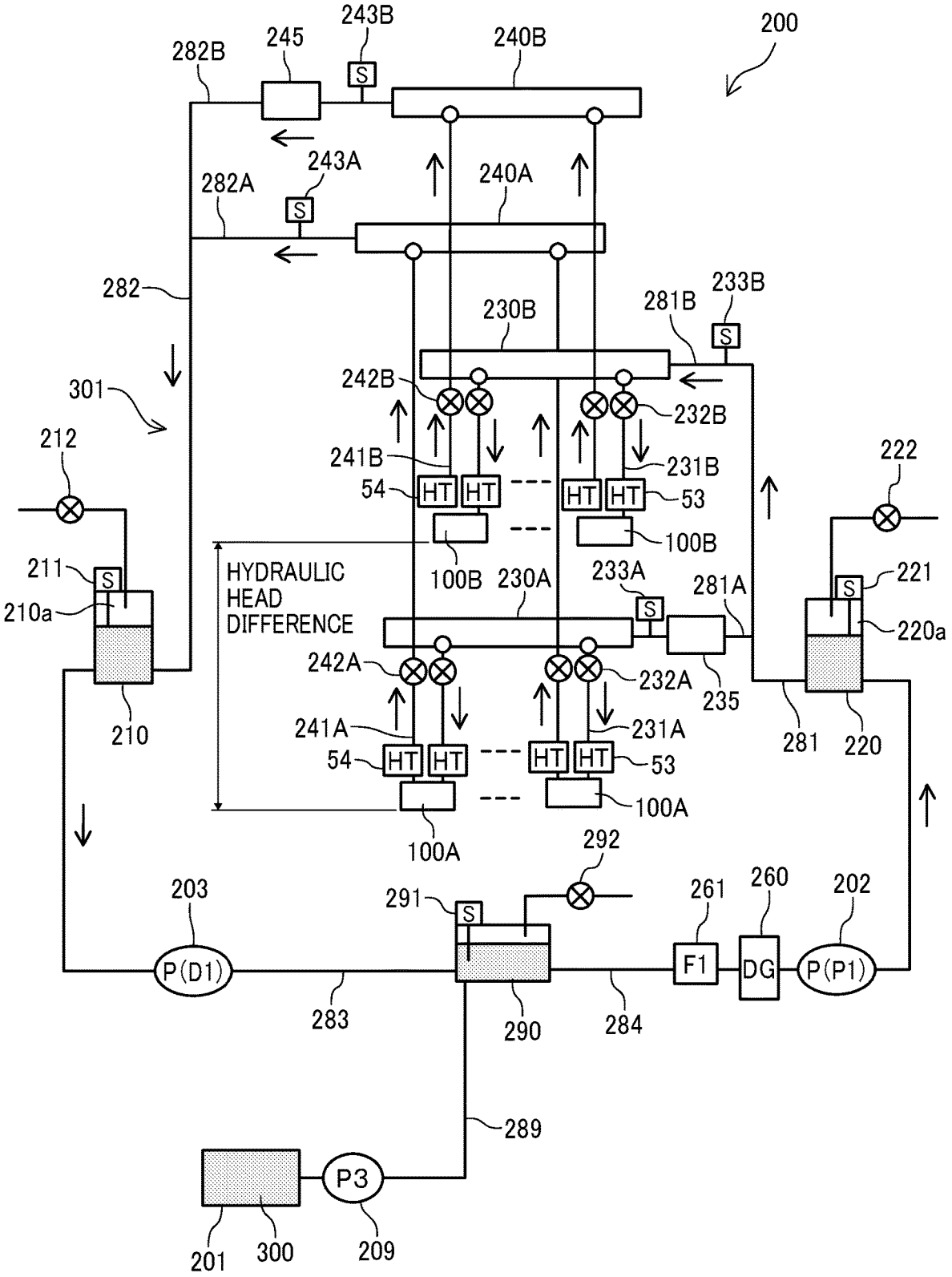
FIG. 6 is a block diagram of a liquid circulation device (liquid supply apparatus) according to a first embodiment of the present disclosure.
Figure 7:
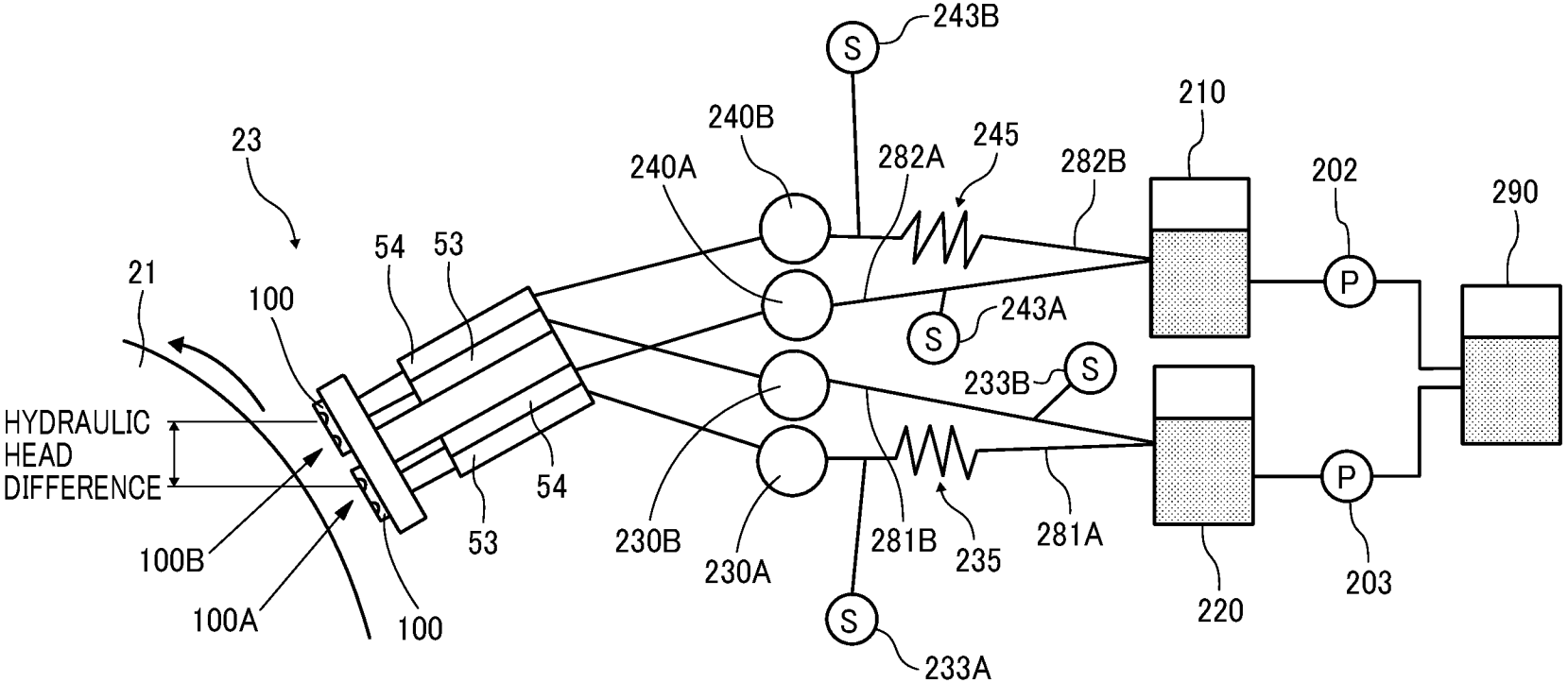
FIG. 7 is a schematic side view of a portion of the liquid circulation device (liquid supply apparatus)

Next, a first embodiment of the present disclosure is described with reference to FIGS. 6 and 7. FIG. 6 is a block diagram of a liquid circulation device (liquid supply apparatus) according to the first embodiment of the present disclosure. FIG. 7 is a schematic side view of a portion of the liquid circulation device (liquid supply apparatus).

The liquid circulation device 200 includes a main tank 201, a pressurized sub-tank 220, a depressurized sub-tank 210, an intermediate sub-tank 290, and a first liquid feed pump 202, a second liquid feed pump 203, and a third liquid feed pump 209. The main tank 201 is a liquid storage to store a liquid 300 to be discharged from the head 100.

The first liquid feed pump 202 is a first pressure adjuster that adjusts the pressure in the pressurized sub-tank 220, and the second liquid feed pump 203 is a second pressure adjustment unit that adjusts the pressure in the depressurized sub-tank 210.

Further, the liquid circulation device 200 includes a first pressurized manifold 230A communicating with the plurality of heads 100 of the head array 100A and a second pressurized manifold 230B communicating with the plurality of heads 100 of the head array 100B. Further, the liquid circulation device 200 includes a first depressurized manifold 240A communicating with the plurality of heads 100 of the head array 100A and a second depressurized manifold 240B communicating with the plurality of heads 100 of the head array 100B.

The intermediate sub-tank 290 is disposed between the pressurized sub-tank 220 and the depressurized sub-tank 210. The liquid is fed (supplied) from the main tank 201 to the intermediate sub-tank 290 by the third liquid feed pump 209 via the liquid channel 289.

The intermediate sub-tank 290 includes a liquid level detector 291 and a solenoid valve 292 that constitutes an air release mechanism to release air inside the intermediate sub-tank 290 to the outside.

The intermediate sub-tank 290 and the depressurized sub-tank 210 are connected through a liquid channel 283. A second liquid feed pump 203 is disposed in the liquid channel 283 between the depressurized sub-tank 210 and the intermediate sub-tank 290.

The depressurized sub-tank 210 includes a gas chamber 210*a* in which liquid and gas coexist. The depressurized sub-tank 210 includes a liquid level detector 211 to detect a liquid level in the depressurized sub-tank 210, and a solenoid valve 212 to serve as an air release mechanism to release air inside the depressurized sub-tank 210 to the outside.

The intermediate sub-tank 290 and the pressurized sub-tank 220 are connected through a liquid channel 284. A first liquid feed pump 202 is disposed in the liquid channel 284 between the pressurized sub-tank 220 and the intermediate sub-tank 290. A degassing device 260 and a filter 261 are disposed in the liquid channel 284.

The pressurized sub-tank 220 includes a gas chamber 220*a* in which liquid and gas coexist. The pressurized sub-tank 220 includes a liquid level detector 221 to detect a liquid level in the pressurized sub-tank 220, and a solenoid valve 222 to serve as an air release mechanism to release air inside the pressurized sub-tank 220 to the outside.

The pressurized sub-tank 220 is connected to the first pressurized manifold 230A through a common liquid channel 281 constituting a supply channel and a first supply channel 281A as an individual supply channel. The pressurized sub-tank 220 is further connected to the second pressurized manifold 230B through a common liquid channel 281 and a second supply channel 281B as an individual supply channel.

The first pressurized manifold 230A communicates with the supply ports 171 of the heads 100 of the head array 100A through the supply channels 231A. The heads 100 of the head array 100A are disposed at a same height. Thus, a plurality of heads 100 of the head array 100A is disposed at the same height. The supply channel 231A is connected to the supply port 171 of the head 100 via the head tank 53. A solenoid valve 232A to open and close the supply channel 231A is provided upstream of the head tank 53 in the supply channel 231A.

The second pressurized manifold 230B communicates with the supply ports 171 of the heads 100 of the head array 100B through the supply channels 231B. The heads 100 of the head array 100B are disposed at a same height. Thus, a plurality of heads 100 of the head array 100B is disposed at the same height. The supply channel 231B is connected to the supply port 171 of the head 100 via the head tank 53. A solenoid valve 232B to open and close the supply channel 231B is provided upstream of the head tank 53 in the supply channel 231B.

Therefore, in the liquid circulation device 200 in present disclosure, the pressurized sub-tank 220 is connected to each head 100 of the head array 100A via the first supply channel 281A. Each head 100 of the head array 100A is disposed lower than each head 100 of the head array 100B. Further, the pressurized sub-tank 220 is connected to each head 100 of the head array 100B via the second supply channel 281B. Each head 100 of the head array 100B is disposed higher than each head 100 of the head array 100A.

The depressurized sub-tank 210 is connected to the first pressurized manifold 230A through a common liquid channel 282 constituting a collection channel and a first collection channel 282A as an individual collection channel. The depressurized sub-tank 210 is further connected to the second depressurized manifold 240B through a common liquid channel 282 and a second collection channel 282B as an individual collection channel.

The first depressurized manifold 240A communicates with the collection ports 172 of the heads 100 of the head array 100A through the collection channels 241A. The collection channel 241A is connected to the collection port 172 of the head 100 via the head tank 54. A solenoid valve 242A to open and close the collection channel 241A is provided upstream of the head tank 54 in the collection channel 241A.

The second depressurized manifold 240B communicates with the collection ports 172 of the heads 100 of the head array 100B through the collection channels 241B. The collection channel 241B is connected to the collection port 172 of the head 100 via the head tank 54. A solenoid valve 242B to open and close the collection channel 241B is provided upstream of the head tank 54 in the collection channel 241B.

Therefore, in the liquid circulation device 200 in present disclosure, the depressurized sub-tank 210 is connected to each head 100 of the head array 100A via the first collection channel 282A. Each head 100 of the head array 100A is disposed lower than each head 100 of the head array 100B. Further, the depressurized sub-tank 210 is connected to each head 100 of the head array 100B via the second collection channel 282B. Each head 100 of the head array 100B is disposed higher than each head 100 of the head array 100A.

A pressure sensor 233A as a first pressure detector is disposed in the first supply channel 281A. A pressure sensor 233B as a second pressure detector is disposed in the second supply channel 281B. A pressure sensor 243A as a first pressure detector is disposed in the first collection channel 282A. A pressure sensor 243B as a second pressure detector is disposed in the second collection channel 282B.

A supply-side fluid restrictor 235 is disposed upstream of the pressure sensor 233A and downstream of the common liquid channel 281 in the first supply channel 281A. The supply-side fluid restrictor 235 increases fluid resistance of one of a supply channel (first supply channel 281A) to be higher than fluid resistance of another of a supply channel (second supply channel 281B).

A collection-side fluid restrictor 245 is disposed downstream of the pressure sensor 243B and upstream of the common liquid channel 282 in the second collection channel 282B. The collection-side fluid restrictor 245 increases fluid resistance of one of a collection channel (second collection channel 282B) to be higher than fluid resistance of another of a collection channel (first collection channel 282A).

If the liquid circulation device 200 does not include the common liquid channel 281, the supply-side fluid restrictor 235 is disposed downstream of the pressurized sub-tank 220 and upstream of the pressure sensor 233A. Similarly, if the liquid circulation device 200 does not include the common liquid channel 282, the collection-side fluid restrictor 245 is disposed upstream of the depressurized sub-tank 210 and downstream of the pressure sensor 243B.

Further, the supply-side fluid restrictor 235 and the collection-side fluid restrictor 245 may have fixed fluid resistance values or may be capable of adjusting fluid resistance values.

Further, the liquid circulation device 200 in the present disclosure does not include a fluid restrictor in another of the supply channel (second supply channel 281B). However, it is sufficient to relatively increase fluid resistance of one of supply channel (first supply channel 281A) to be higher than fluid resistance of another of supply channel (second supply channel 281B) by the supply-side fluid restrictor 235. Thus, a fluid restrictor may also be provided on the second supply channel 281B. Further, the liquid circulation device 200 in the present disclosure does not include a fluid restrictor in another of the collection channel (first collection channel 282A). However, it is sufficient to relatively increase fluid resistance of one of collection channel (second collection channel 282B) to be higher than fluid resistance of another of collection channel (first collection channel 282A) by the collection-side fluid restrictor 245. Thus, a fluid restrictor may also be provided on the first collection channel 282A. Details of a fluid restrictor are to be further described below.

Here, liquid is circulated in a circulation channel 301 such that the liquid flows from the intermediate sub-tank 290 and returns to the intermediate sub-tank 290 through the liquid channel 284, the pressurized sub-tank 220, the common liquid channel 281, the first supply channel 281A and the second supply channel 281B, the first pressurized manifold 230A and the second pressurized manifold 230B, the heads 100, the first depressurized manifold 240A and the second depressurized manifold 240B, the first collection channel 282A and the second collection channel 282B, the common liquid channel 282, the depressurized sub-tank 210, and the liquid channel 283.

Further, the pressurized sub-tank 220, the depressurized sub-tank 210, the first liquid feed pump 202, and the second liquid feed pump 203 constitute a device to generate a pressure to circulate a liquid through the circulation channel 301.

Next, a liquid circulation method in the liquid circulation device 200 according to the first embodiment is described below. Here, in order to describe the entire flow in the liquid circulation device 200, it is assumed that a height of each of the heads 100 is at the same height.

(1) Liquid flow from the main tank 201 to the intermediate sub-tank 290

When the liquid level detector 291 detects a shortage of liquid in the intermediate sub-tank 290, the liquid circulation device 200 drives the third liquid feed pump 209 to cause the liquid in the main tank 201 to flow through the liquid channel 289 to the intermediate sub-tank 290 until the liquid level in the intermediate sub-tank is detected to be full by the liquid level detector 291.

(2) Liquid flow from the intermediate sub-tank 290 to the pressurized sub-tank 220

The liquid circulation device 200 drives the first liquid feed pump 202 to feed the liquid from the intermediate sub-tank 290 to the pressurized sub-tank 220 via the liquid channel 284.

(3) Liquid flow from the depressurized sub-tank 210 to the intermediate sub-tank 290

The liquid circulation device 200 drives the second liquid feed pump 203 to feed the liquid from the depressurized sub-tank 210 to the intermediate sub-tank 290 via the liquid channel 283.

(4) Liquid flow from the pressurized sub-tank 220 to the depressurized sub-tank 210 through circulatable heads 100

The liquid circulation device 200 drives the first liquid feed pump 202 to feed the liquid from the intermediate sub-tank 290 to the pressurized sub-tank 220 until each of the pressure sensors 233A and 233B detects a target pressure (positive pressure, for example). Further, the liquid circulation device 200 drives the second liquid feed pump 203 to feed the liquid from the depressurized sub-tank 210 to the intermediate sub-tank 290 until each of the pressure sensors 243A and 243B detects a target pressure (negative pressure, for example).

Thus, a pressure difference is generated between the pressurized sub-tank 220 and the depressurized sub-tank 210 that enables the liquid to circulate from the pressurized sub-tank 220 to the depressurized sub-tank 210 through the common liquid channel 281, the first supply channel 281A and the second supply channel 281B, the first pressurized manifold 230A and the second pressurized manifold 230B, the supply channels 231A and 231B, the head tanks 53, the heads 100, the collection channels 241A and 241B, the head tanks 54, the first depressurized manifold 240A and the second depressurized manifold 240B, the first collection channel 282A and the second collection channel 282B, and the common liquid channel 282.

A liquid level detector implemented by a float, by at least two or more electrode pins, or by using a laser, for example, may be used as the liquid level detector 211 and 221. Using at least two or more electrode pins detects the liquid according to output of a voltage detected by the electrode pins.

Further, the solenoid valves 222 and 212 may be driven to cause the insides of the pressurized sub-tank 220 and the depressurized sub-tank 210 to be communicated with the atmosphere.

Next, a formation of negative pressure in nozzle meniscus in the nozzle 104 is described below. The negative pressure is formed to set a pressure in the pressurized sub-tank 220 and the depressurized sub-tank 210.

In general, when liquid is discharged from the head 100, the pressure applied to the nozzle meniscus is controlled to a negative pressure. The negative pressure in the nozzle meniscus prevents the liquid in the nozzle 104 from leaking from the nozzle 104. Further, when the liquid is discharged from the nozzle 104 at high speed, inertia of the fluid acts at a start and an end of a discharge operation. Thus, pressure pulsation may occur on the nozzle meniscus in the nozzle 104. At this time, the positive pressure may be temporarily generated in the nozzle 104. However, controlling the pressure in the nozzle 104 to be negative can prevent the liquid from leaking from the nozzle 104 even when the pulsation of the pressure occurs in the nozzle 104.

When a head 100 of flow-through type is used, generally, a positive pressure is applied (set) to the pressurized sub-tank 220 and a negative pressure is applied (set) to the depressurized sub-tank 210 to generate positive pressure on a supply side of the head 100 and to generate negative pressure on a collection side of the head 100.

The pressure set in the sub tank depends on a pressure loss of the fluid resistance of the circulation channel 301 from the pressurized sub-tank 220 to the head 100 and the fluid resistance of the circulation channel 301 from the head 100 to the depressurized sub-tank 210. For stable discharge of the head 100, it is important to hold steady the pressure on the supply-side just before the head 100 and the pressure on the collection-side just after the head 100.

A fluid resistance from just before the head 100 to the nozzle 104 in the head 100 is referred to herein as "Rin", and a fluid resistance from the nozzle 104 to just after the head 100 is referred to as "Rout". "Rin" and "Rout" are obtained by either calculation or measurement. Further, a pressure just before the head 100 is referred to herein as "Pin", and the pressure just after the head 100 is referred to as "Pout". Similar to a partial pressure of a series resistance, a target pressure Pm can be generated in the nozzle meniscus according to a ratio of the fluid resistances Rin and Rout and the value of the pressures Pin and Pout.

Thus, a flow rate of a liquid circulated in the circulation channel 301 is indicated by "I".

Pin−Pm=I×Rin Pm−Pout=I×Rout Here, the equation (1) is obtained by removal of I from both sides of the equation and rewriting of the equation after removal of I.

$$Pm=(Pout+Rout/Rin\times Pin)/(1+Rout/Rin) \quad \text{[Equation 1]}$$

In this equation (1), if Rin=Rout, then Pm=(Pout+Pin)/2.

Therefore, it can be seen that the pressure of the meniscus is determined according to the set pressure Pin and Pout and the ratio of the fluid resistances Rin and Rout. From the above-description, the pressure to be set to the pressurized sub-tank 220 and the depressurized sub-tank 210 is set according to the above-mentioned formula according to the fluid resistance from the pressurized sub-tank 220 to the nozzle 104 and the fluid resistance from the nozzle 104 to the depressurized sub-tank 210.

Figure 8:
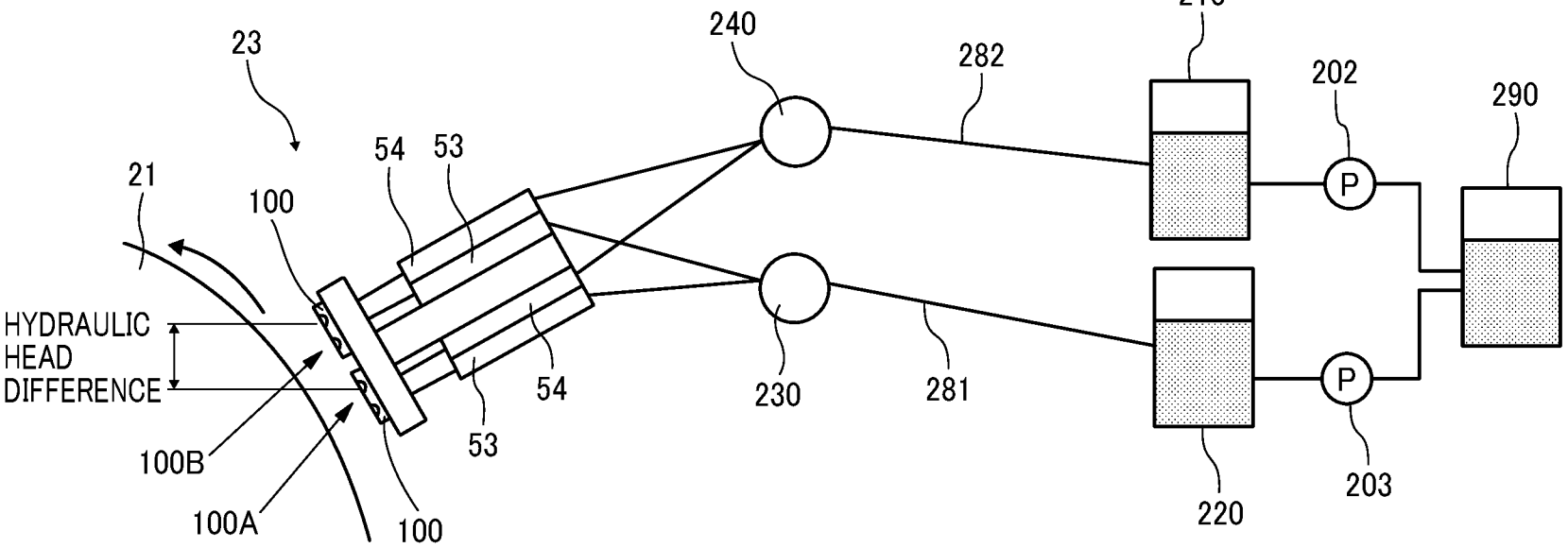
FIG. 8 is a schematic cross-sectional view of a liquid circulation system according to a Comparative Example 1.

Here, a liquid circulation device of Comparative Example 1 is described with reference to FIG. 8. FIG. 8 is a schematic cross-sectional view of a liquid circulation system according to the Comparative Example 1.

In Comparative Example 1, the liquid circulation device includes a pressurized manifold 230 commonly connected to the heads 100 of the head array 100A and the heads 100 of the head array 100B and the depressurized manifold 240 commonly connected to the heads 100 of the head array 100A and the heads 100 of the head array 100B.

The discharge unit 23 is disposed to be inclined around the carrying drum 21. Thus, a hydraulic head difference occurs between the nozzles 104 of the head 100 of the head array 100A and the nozzles 104 of the head 100 of the head array 100B.

Therefore, even if the pressurized manifold 230 and the depressurized manifold 240 are controlled to the same pressure, the pressure just before the head 100 of the head array 100A becomes different from the pressure just before the head 100 of the head array 100B by the hydraulic head difference. Thus, the meniscus pressures are different between the head array 100A and the head array 100B.

Figure 9:
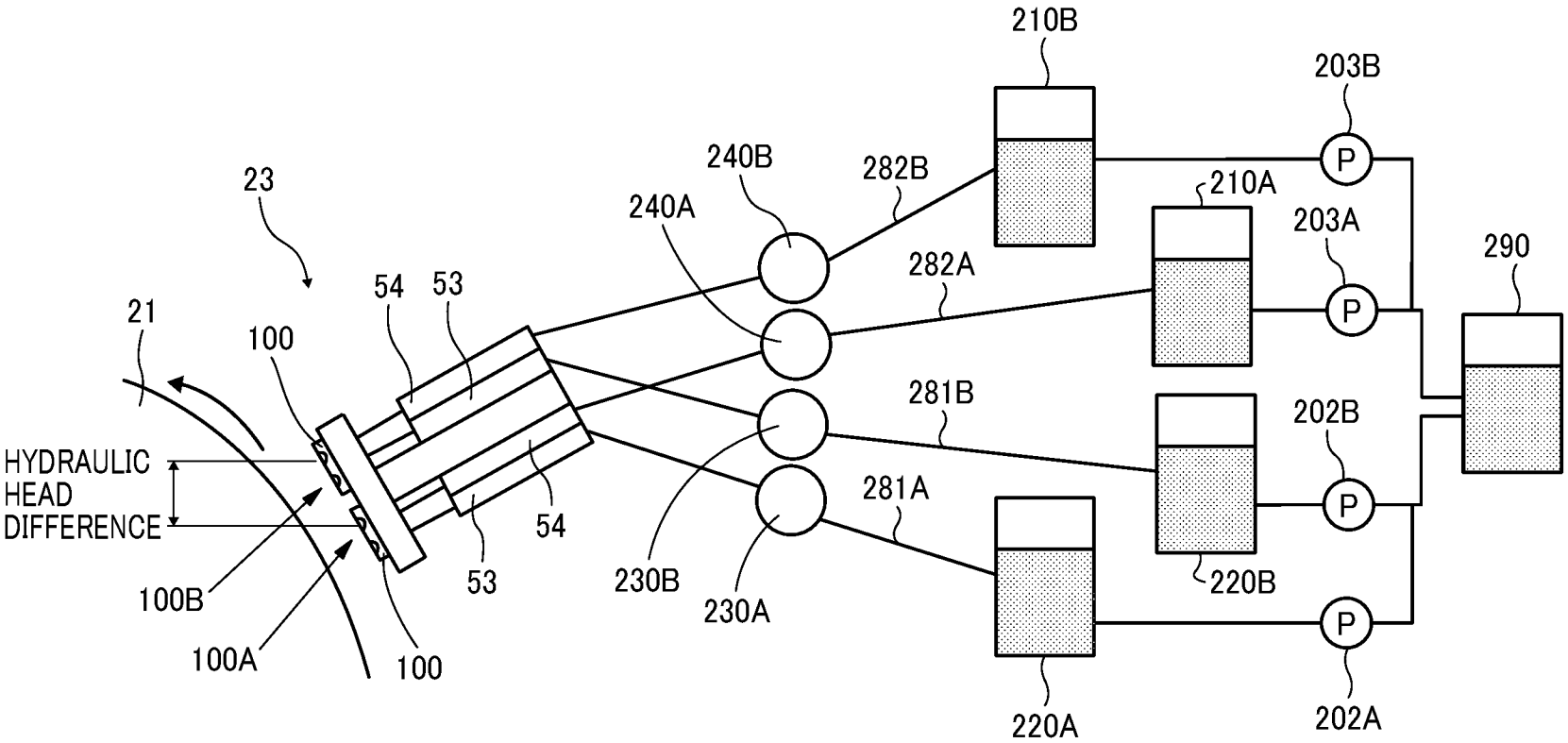
FIG. 9 is a schematic cross-sectional view of a liquid circulation system according to a Comparative Example 2.

Next, the liquid circulation device of Comparative Example 2 is described with reference to FIG. 9. FIG. 9 is a schematic cross-sectional view of a liquid circulation system according to the Comparative Example 2.

In Comparative Example 2, the liquid circulation device includes a first pressurized manifold 230A connected to the head array 100A, a second pressurized manifold 230B connected to the head array 100B, a first depressurized manifold 240A connected to the head array 100A, and a second depressurized manifold 240B connected to the head array 100B. Thus, the first pressurized manifold 230A, the second pressurized manifold 230B, the first depressurized manifold 240A, and the second depressurized manifold 240B are uniquely provided to each of the head arrays 100A and 100B.

Further, the liquid circulation device includes a first pressurized sub-tank 220A and a first liquid feed pump 202A communicating with the first pressurized manifold 230A, and a second pressurized sub-tank 220B and a second liquid feed pump 202B communicating with the first pressurized manifold 230A, Further, the liquid circulation device includes a second depressurized sub-tank 210A and a second liquid feed pump 203A communicating with the first depressurized manifold 240A, and a second depressurized sub-tank 210B and a second liquid feed pump 203B communicating with the second depressurized manifold 240B.

The configuration in the Comparative Example 2 can control the pressure in each of the head arrays 100A and 100B and can cancel the hydraulic head difference. However, the liquid circulation device of the Comparative Example 2 needs a system for controlling pressures in each of the head arrays 100A and 100B, and thus the configuration of the liquid circulation device becomes complicated.

Conversely to the configurations of Comparative Example 1 and Comparative Example 2 as described above, the liquid circulation device 200 in the first embodiment includes the pressurized sub-tank 220 communicating with the first pressurized manifold 230A via the first supply channel 281A and communicating with the second pressurized manifold 230B via the second supply channel 281B. Similarly, the liquid circulation device 200 in the first embodiment further includes the depressurized sub-tank 210 communicating with the first depressurized manifold 240A via the first collection channel 282A and communicating with the second depressurized manifold 240B via the second collection channel 282B.

Further, the liquid circulation device 200 includes the supply-side fluid restrictor 235 in the first supply channel 281A and the collection-side fluid restrictor 245 in the second collection channel 282B.

That is, the liquid circulation device 200 adjusts a fluid resistance value of the supply-side fluid restrictor 235 to cause a fluid resistance value of the first supply channel 281A changeable. The first supply channel 281A communicates with the first pressurized manifold 230A communicating with the head array 100A disposed lower than the head array 100B between the head arrays 100A and 100B.

Similarly, the liquid circulation device 200 adjusts a fluid resistance value of the collection-side fluid restrictor 245 to cause a fluid resistance value of the second collection channel 282B changeable. The second collection channel 282B communicates with the second depressurized manifold 240B communicating with the head array 100B disposed higher than the head array 100A between the head arrays 100A and 100B.

Thus, when the liquid is circulated without discharged from the head 100, each of the fluid resistance values of the supply-side fluid restrictor 235 and the collection-side fluid restrictor 245 are controlled to cancel the difference of the pressures due to the hydraulic head difference between the head arrays 100A and 100B.

Further, when the liquid is discharged from the head 100, the liquid circulation device 200 can reduces each fluid resistance values of the supply-side fluid restrictor 235 and the collection-side fluid restrictor 245 to suppress an increase of a pressure loss due to increase in a flow rate by liquid discharge.

Specifically, first, the pressure sensor 233B detects a pressure in the second pressurized manifold 230B on a pressurized side. Then, the liquid circulation device 200 controls the pressure in the pressurized sub-tank 220 to become a target pressure with reference to the head 100 of the head array 100B by the first liquid feed pump 202.

In the case as described above, if the liquid circulation device 200 does not include the supply-side fluid restrictor 235, a positive pressure larger than the target pressure may be applied to the head 100 of the head array 100A since the head 100 of the head array 100B is used as a reference. The meniscus pressure of the head 100 of the head array 100A is shifted to the positive pressure side, and a liquid may be leaked from the nozzles 104.

Thus, the liquid circulation device 200 includes the supply-side fluid restrictor 235 having a fluid resistance that lowers a pressure equivalent to the hydraulic head difference between the head 100 of the head array 100A and the head 100 of the head array 100B.

Similarly, the pressure sensor 243A detects a pressure of the first depressurized manifold 240A also on a depressurized side. Then, the liquid circulation device 200 controls the pressure in the depressurized sub-tank 210 to become a target pressure with reference to the head 100 of the head array 100A by the second liquid feed pump 203.

In the case as described above, if the liquid circulation device 200 does not include the collection-side fluid restrictor 245, a negative pressure larger than the target pressure may be applied to the head 100 of the head array 100B since the head 100 of the head array 100A is used as a reference. The meniscus pressure of the head 100 of the head array 100B is shifted to the negative pressure side, and a liquid in the nozzles 104 may caught air into the nozzles 104.

Thus, the liquid circulation device 200 includes the collection-side fluid restrictor 245 having a fluid resistance that lowers a pressure equivalent to the hydraulic head difference between the head 100 of the head array 100A and the head 100 of the head array 100B.

Thus, even if the liquid circulation device 200 includes the head arrays 100A and 100B disposed at different heights, the liquid circulation device 200 controls a pressure of one set of pressurized sub-tank 220 and the depressurized sub-tank 210. Thus, the liquid does not leak from the nozzle 104 in each of head arrays 100A and 100B. Further, the liquid circulation device 200 can maintain a range of the meniscus pressure so that the liquid in the nozzles 104 do not catch an air bubble into the nozzles 104 of the heads 100.

Figure 10:
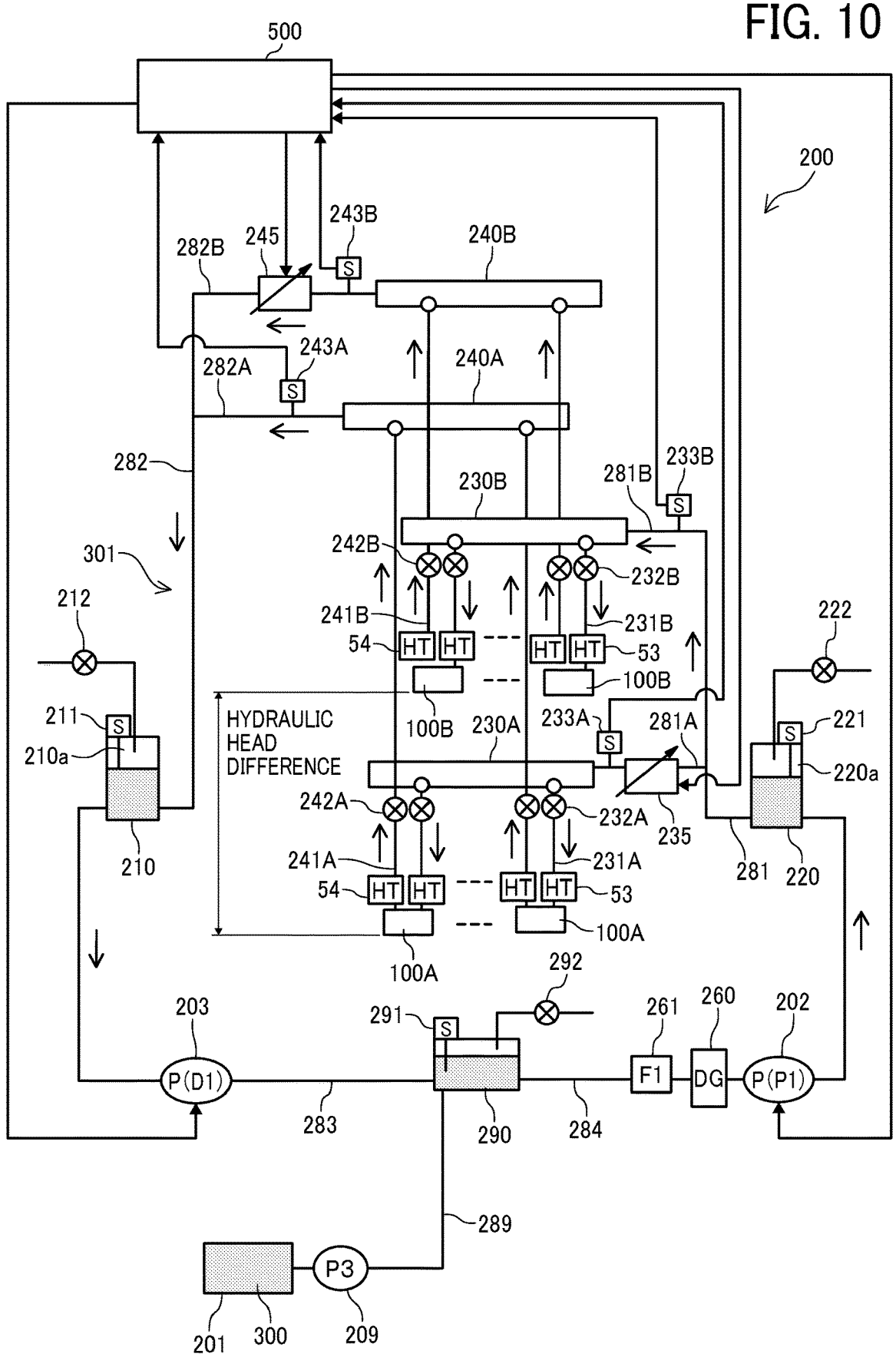
FIG. 10 is a block diagram of a liquid circulation device according to a second embodiment of the present disclosure.

Next, a second embodiment of the present disclosure is described with reference to FIG. 10. FIG. 10 is a block diagram of the liquid circulation device according to the present disclosure.

In the present disclosure, the liquid circulation device 200 includes a fluid restrictor to adjust fluid resistance (variable fluid restrictor) as the supply-side fluid restrictor 235 and the collection-side fluid restrictor 245. Thus, the fluid restrictors of the supply-side fluid restrictor 235 and the collection-side fluid restrictor 245 can change and adjust the fluid resistance values. The liquid circulation device 200 includes a controller 500 as control circuitry.

Thus, as described in the first embodiment as illustrated in FIGS. 6 and 7, when the supply-side fluid restrictor 235 and the collection-side fluid restrictor 245 having fluid resistance corresponding to the hydraulic head difference are arranged in the liquid circulation device 200, no problem occurs when the hydraulic head difference is small. However, when the hydraulic head difference becomes large, the fluid resistance of each of the supply-side fluid restrictor 235 and the collection-side fluid restrictor 245 has to be increased correspondingly.

Then, no problem occurs when the liquid is circulated in a non-discharge state in which the liquid is not discharged from the head 100. However, when the head 100 discharges a liquid, the meniscus pressure becomes different between the head arrays 100A and 100B due to balance of fluid resistance between upstream of the head 100 and downstream of the head 100 by influence of refilling the liquid to the heads 100 of the head arrays 100A and 100B. Thus, number of discharged droplets may vary between the head arrays 100A and 100B and may cause degradation of the image quality, for example.

Therefore, the liquid circulation device 200 according to the present disclosure includes fluid restrictors (variable fluid restrictors) capable of adjusting fluid resistance as the supply-side fluid restrictor 235 and the collection-side fluid restrictor 245. Thus, the fluid resistance values of the supply-side fluid restrictor 235 and the collection-side fluid restrictor 245 are adjusted according to a pressure of the second supply channel 281B and a pressure of the first collection channel 282A.

For example, the liquid circulation device 200 detects the pressure by the pressure sensor 233B and feed the liquid to the pressurized sub-tank 220 by the first liquid feed pump 202 so that the pressure detected by the pressure sensor 233B becomes the target pressure on the pressurized side. Then, the liquid circulation device 200 detects the pressure by the pressure sensor 233A and changes the fluid resistance of the supply-side fluid restrictor 235 so that the pressure detected by the pressure sensor 233A becomes the target pressure.

The liquid circulation device 200 detects the pressure by the pressure sensor 243A and feeds the liquid to the intermediate sub-tank 290 by the second liquid feed pump 203 from the depressurized sub-tank 210 so that the pressure detected by the pressure sensor 243A becomes the target pressure on the depressurized side. Then, the liquid circulation device 200 detects the pressure by the pressure sensor 243B and changes the fluid resistance of the collection-side fluid restrictor 245 so that the pressure detected by the pressure sensor 243B becomes the target pressure.

Thus, even when the pressure is decreased due to the influence of the refilling operation of the liquid to the heads 100 at the time of liquid discharge, the liquid circulation device 200 can reduce the fluid resistance of the supply-side fluid restrictor 235 and the collection-side fluid restrictor 245 to compensate for the flow rate and maintain the meniscus pressure in an appropriate range.

An output value of the pressure adjuster and a resistance value of the fluid restrictor can be determined, for example, according to following procedures (1) and (2). As described above, the first liquid feed pump 202 is a first pressure adjuster that adjusts the pressure in the pressurized sub-tank 220, and the second liquid feed pump 203 is a second pressure adjuster that adjusts the pressure in the depressurized sub-tank 210. Further, the fluid restrictor includes the supply-side fluid restrictor 235 and the collection-side fluid restrictor 245.

(1) The controller 500 as control circuitry determines an output value of the pressure of the second pressure adjuster (second liquid feed pump 203) according to a detection result of a second pressure detector (pressure sensor 243B). Further, the controller 500 determines a resistance value of the collection-side fluid restrictor 245 from a detection result of a first pressure detection unit (pressure sensor 243A).

Further, the controller 500 determines an output value of the pressure of the first pressure adjuster (first liquid feed pump 202) according to a detection result of a third pressure detector (pressure sensor 233A). Further, the controller 500 determines a resistance value of the supply-side fluid restrictor 235 from a detection result of a fourth pressure detection unit (pressure sensor 233B).

Functions executed by the controller 500 may be implemented by one or more processing circuits or circuitry. Processing circuitry includes a programmed processor, as a processor includes circuitry. A processing circuit also includes devices such as the central processing unit (CPU), an application specific integrated circuit (ASIC), digital signal processor (DSP), field programmable gate array (FPGA), and conventional circuit components arranged to perform the recited functions.

As a result, the controller 500 of the liquid circulation device 200 can compensate for a shortage of the flow rate at the time of liquid discharge and maintain the image quality.

(2) First, the controller 500 determines the output value of the pressure of the second pressure adjuster (second liquid feed pump 203) according to the detection result of the second pressure detector (pressure sensor 243B). Then, the controller 500 determines a resistance value of the collection-side fluid restrictor 245 from a detection result of a first pressure detection unit (pressure sensor 243A). Then, the controller 500 determines the output value of the pressure of the first pressure adjuster (first liquid feed pump 202) according to a detection result of a third pressure detector (pressure sensor 233A). Then, the controller 500 determines the resistance value of the supply-side fluid restrictor 235 from the detection result of the fourth pressure detection unit (pressure sensor 233B).

Thus, the controller 500 of the liquid circulation device 200 controls a pressure source as an origination of a pressure first to enable the pressure to efficiently approach the target pressure value.

Figure 11:
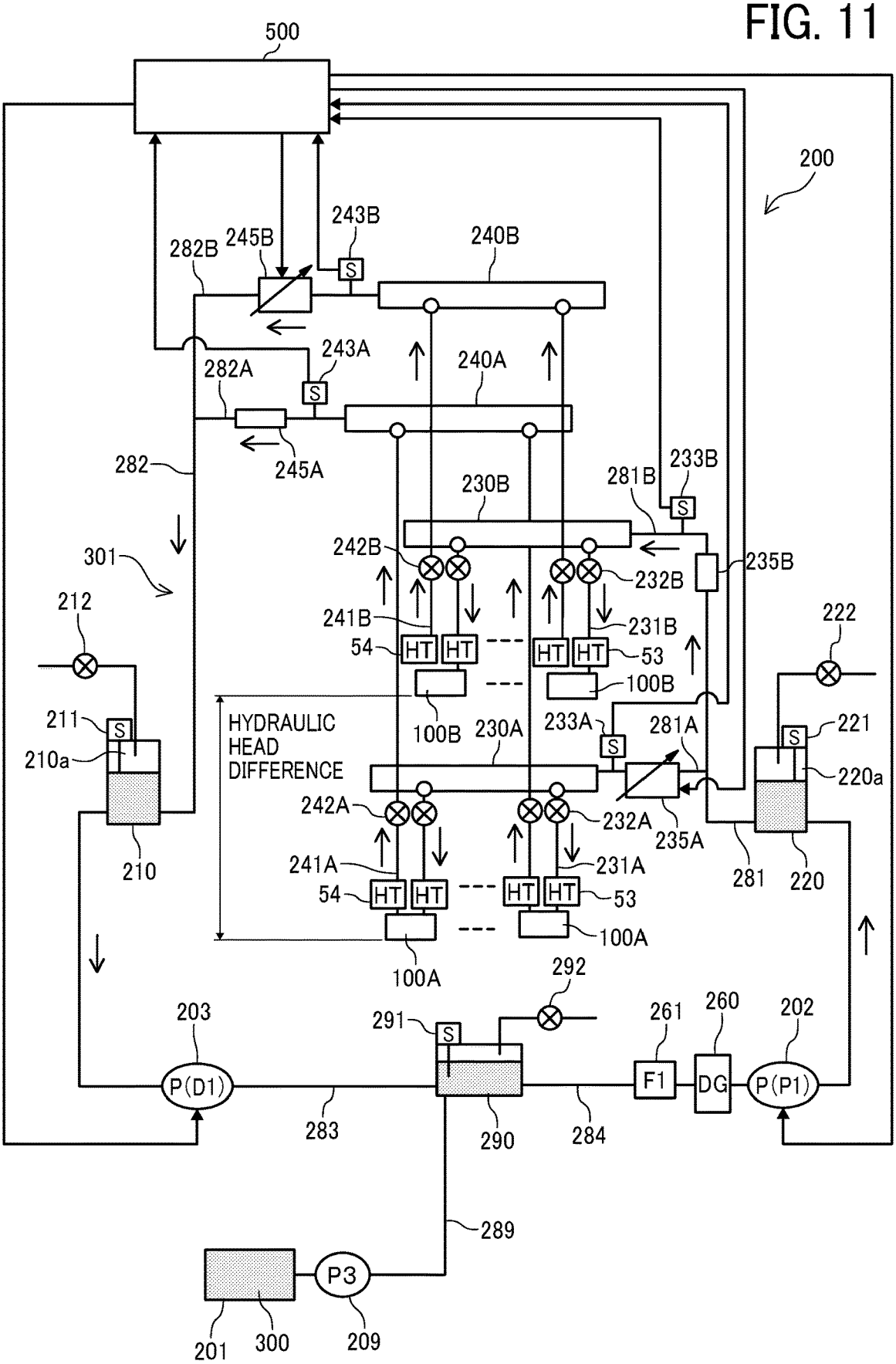
FIG. 11 is a block diagram of a liquid circulation device according to a third embodiment of the present disclosure.

Next, a third embodiment of the present disclosure is described with reference to FIG. 11. FIG. 11 is a block diagram of the liquid circulation device according to the present disclosure.

The liquid circulation device 200 in the present disclosure includes a first supply-side fluid restrictor 235A disposed in the first supply channel 281A and a second supply-side fluid restrictor 235B disposed in the second supply channel 281B. The first supply-side fluid restrictor 235A and the second supply-side fluid restrictor 235B cancel the hydraulic head difference between the head arrays 100A and 100B as described in the first embodiment or the second embodiment. Further, the first supply-side fluid restrictor 235A and the second supply-side fluid restrictor 235B control the fluid resistance of the first supply channel 281A to be smaller than the fluid resistance of the second supply channel 281B at the time of liquid discharge.

The liquid circulation device 200 in the present disclosure includes the first collection-side fluid restrictor 245A in the first collection channel 282A and the second collection-side fluid restrictor 245B in the second collection channel 282B. The first collection-side fluid restrictor 245A and the second collection-side fluid restrictor 245B may cancel the hydraulic head difference as described in the first embodiment or the second embodiment. Alternatively, the first supply-side fluid restrictor 235A and the second supply-side fluid restrictor 235B may control the fluid resistance of the second collection channel 282B to be smaller than the fluid resistance of the first collection channel 282A at the time of liquid discharge.

Figure 12A:
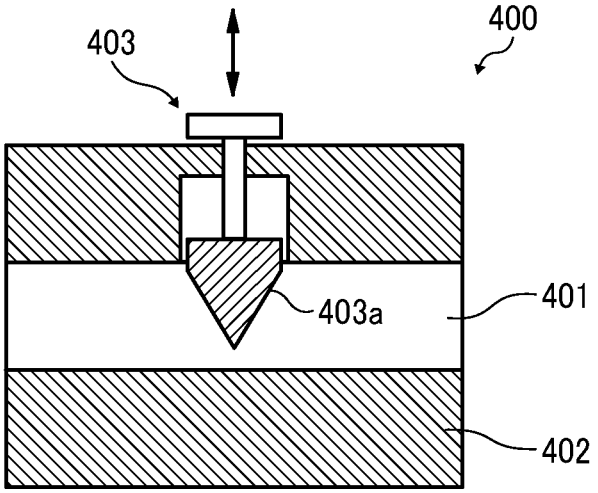
FIGS. 12A and 12B are cross-sectional views of a first example of a variable fluid restrictor.
Figure 12B:
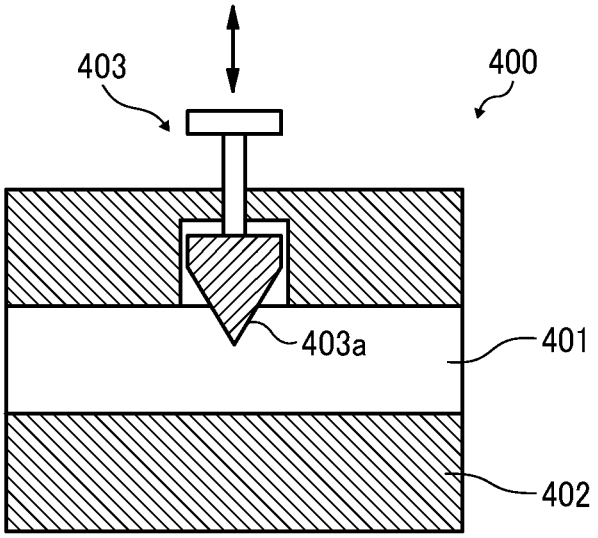

Next, a first example of the variable fluid restrictor is described with reference to FIG. 12. FIG. 12 is a cross-sectional view the first example of the variable fluid restrictor.

The variable fluid restrictor 400 includes a cross-sectional area adjustment member 403 advanceable and retractable (movable) with respect to a channel 401 in the channel forming member 402 that forms the channel 401. The cross-sectional area adjustment member 403 includes a cross-sectional area adjustment part 403*a*. The cross-sectional area adjustment part 403*a* includes a conical tip in a leading end of the cross-sectional area adjustment part 403*a*.

Thus, an entry amount of the cross-sectional area adjustment member 403 toward the channel 401 is adjusted to change a cross-sectional area of the channel 401 (cross-sectional area of opening) through which the liquid can flow, and thus the fluid resistance value of the channel 401 can be adjusted. In a state illustrated in FIG. 12A, the cross-sectional area of opening of the channel 401 is relatively larger than the cross-sectional area of opening of the channel 401 in the state illustrated in FIG. 12B. Thus, the fluid resistance illustrated in FIG. 12B becomes smaller than the fluid resistance illustrated in FIG. 12A.

Figure 13:
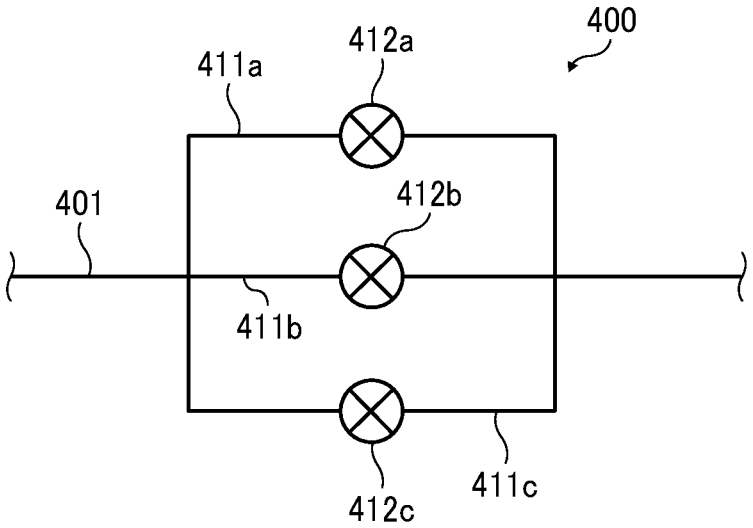
FIG. 13 is a circuit diagram of a second example of a variable fluid restrictor.

Next, a second example of the variable fluid restrictor is described with reference to FIG. 13. FIG. 13 is a circuit diagram of the variable fluid restrictor.

A variable fluid restrictor 400 includes a plurality of (three in FIG. 13) branch channels 411*a* to 411*c* arranged in parallel in the channel 401. The variable fluid restrictor 400 further includes valves 412*a* to 412*c* such as solenoid valves to open and close the branch channels 411*a* to 411*c*, respectively.

Thus, the variable fluid restrictor 400 can control to open and close the valves 412*a* to 412*c* to change number of the branch channels 411*a* to 411*c* (number of channels) through which the liquid flows. Thus, the variable fluid restrictor 400 can adjust (vary) the fluid resistance of the channel 401.

Figure 14:
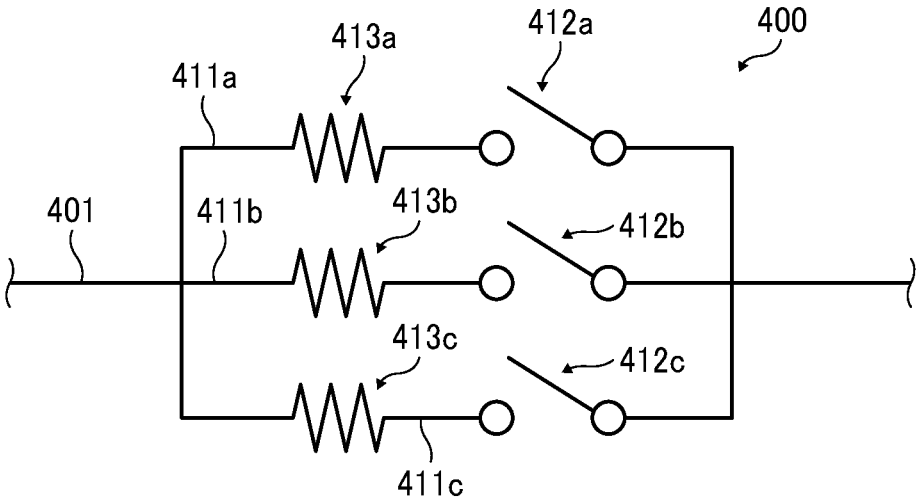
FIG. 14 is a circuit diagram of a third example of a variable fluid restrictor.

Next, a third example of the variable fluid restrictor is described with reference to FIG. 14. FIG. 14 is a circuit diagram of the variable fluid restrictor.

A variable fluid restrictor 400 includes a plurality of (three in FIG. 13) branch channels 411*a* to 411*c* arranged in parallel in the channel 401. The variable fluid restrictor 400 further includes valves 412*a* to 412*c* such as solenoid valves to open and close the branch channels 411*a* to 411*c*, respectively. Further, fluid restrictors 413*a* to 413*c* having different fluid resistance values are disposed in the branch channels 411*a* to 411*c*, respectively.

Thus, the variable fluid restrictor 400 can control to open and close the valves 412*a* to 412*c* to change number of the branch channels 411*a* to 411*c* (number of channels) through which the liquid flows and the fluid resistance value of the branch channels 411*a* to 411*c*. Thus, the variable fluid restrictor 400 can adjust (vary) the fluid resistance of the channel 401.

As described above, the liquid circulation device 200 according to the present disclosure can reduce difference (variation) of the meniscus pressure between the heads 100 or between the head arrays 100A and 100B with simple configuration.

Further, "liquid" discharged from a liquid discharge head is not particularly limited as long as the liquid has a viscosity and surface tension of degrees dischargeable from the liquid discharge head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The term "liquid discharge apparatus" used herein also represents an apparatus including the liquid discharge head to discharge liquid by driving the liquid discharge head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional apparatus to discharge a molding liquid to a powder layer in which powder material is formed in layers, so as to form a three-dimensional article.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate. Examples of the "material on which liquid can be adhered" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

The "liquid discharge apparatus" may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Functions executed by the controller 500 may be implemented by one or more processing circuits or circuitry. Processing circuitry includes a programmed processor, as a processor includes circuitry. A processing circuit also includes devices such as the central processing unit (CPU), an application specific integrated circuit (ASIC), digital signal processor (DSP), field programmable gate array (FPGA), and conventional circuit components arranged to perform the recited functions.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid circulation device comprising:

a first liquid discharge head to discharge a liquid;

a first supply channel to supply the liquid to the first liquid discharge head;

a first collection channel to collect the liquid from the first liquid discharge head;

a second liquid discharge head to discharge the liquid and disposed higher than the first liquid discharge head;

a second supply channel to supply the liquid to the second liquid discharge head;

a second collection channel to collect the liquid from the second liquid discharge head;

a supply-side fluid restrictor disposed in the first supply channel to make a fluid resistance value of the first supply channel greater than a fluid resistance value of the second supply channel; and a collection-side fluid restrictor disposed in the second collection channel to make a fluid resistance value of the second collection channel greater than a fluid resistance value of the first collection channel, wherein the supply-side fluid restrictor changes the fluid resistance value of the first supply channel to be higher than the fluid resistance value of the second supply channel, the supply-side fluid restrictor includes a plurality of branch channels having an identical resistance value arranged parallel to the first supply channel, and the supply-side fluid restrictor changes a number of the plurality of branch channels to change the fluid resistance value of the first supply channel.

2. The liquid circulation device according to claim 1, further comprising:

a pressurized sub-tank connected to the first liquid discharge head via the first supply channel and connected to the second liquid discharge head via the second supply channel to accommodate the liquid to be supplied to the first liquid discharge head and the second liquid discharge head; and a depressurized sub-tank connected to the first liquid discharge head via the first collection channel and connected to the second liquid discharge head via the second collection channel to accommodate the liquid collected from the first liquid discharge head and the second liquid discharge head.

3. The liquid circulation device according to claim 2, wherein the first liquid discharge head includes a first nozzle face in which a plurality of nozzles is formed to discharge the liquid, the second liquid discharge head includes a second nozzle face in which a plurality of nozzles is formed to discharge the liquid, and a height of the second nozzle face is higher than a height of the first nozzle face.

4. The liquid circulation device according to claim 3, further comprising:

a plurality of first liquid discharge heads each including the first nozzle face disposed at a same height;

a first pressurized manifold communicating with the plurality of first liquid discharge heads via the first supply channel;

a first depressurized manifold communicating with the plurality of first liquid discharge heads via the first collection channel;

a plurality of second liquid discharge heads each including the second nozzle face disposed at a same height, the height of the second nozzle face being higher than the height of the first nozzle face;

a second pressurized manifold communicating with the plurality of second liquid discharge heads via the second supply channel; and a second depressurized manifold communicating with the plurality of second liquid discharge heads via the second collection channel.

5. The liquid circulation device according to claim 4, further comprising:

a first pressure adjuster to adjust a pressure in the pressurized sub-tank;

a first pressure detector to detect a pressure in the first collection channel that connects the first depressurized manifold and the depressurized sub-tank;

a second pressure adjuster to adjust a pressure in the depressurized sub-tank;

a second pressure detector to detect a pressure in the second collection channel that connects the second depressurized manifold and the depressurized sub-tank;

a third pressure detector to detect a pressure in the first supply channel that connects the first pressurized manifold and the pressurized sub-tank;

a fourth pressure detector to detect a pressure in the second supply channel that connects the second pressurized manifold and the pressurized sub-tank; and circuitry to:

determine a fluid resistance value of the collection-side fluid restrictor according to the pressure detected by the first pressure detector;

determine an output value of the pressure of the second pressure adjuster according to the pressure detected by the second pressure detector;

determine an output value of the pressure of the first pressure adjuster according to the pressure detected by the third pressure detector; and determine a fluid resistance value of the supply-side fluid restrictor according to the pressure detected by the fourth pressure detector.

6. The liquid circulation device according to claim 5, wherein the circuitry:

determines the fluid resistance value of the collection-side fluid restrictor according to the pressure detected by the first pressure detector after determining the output value of the pressure of the second pressure adjuster according to the pressure detected by the second pressure detector; and determines the fluid resistance value of the supply-side fluid restrictor according to the pressure detected by the fourth pressure detector after determining the output value of the pressure of the first pressure adjuster according to the pressure detected by the third pressure detector.

7. The liquid circulation device according to claim 1, wherein the supply-side fluid restrictor changes a cross-sectional area of the first supply channel to change the fluid resistance value of the first supply channel.

8. The liquid circulation device according to claim 1, wherein the collection-side fluid restrictor changes the fluid resistance value of the second collection channel to be higher than the fluid resistance value of the first collection channel.

9. The liquid circulation device according to claim 8, wherein the collection-side fluid restrictor changes a cross-sectional area of the second collection channel to change the fluid resistance value of the second collection channel.

10. The liquid circulation device according to claim 8, wherein the collection-side fluid restrictor includes a plurality of branch channels having an identical resistance value arranged parallel to the second collection channel, and the collection-side fluid restrictor changes a number of the plurality of branch channels to change the fluid resistance value of the second collection channel.

11. The liquid circulation device according to claim 8, wherein the collection-side fluid restrictor includes a plurality of branch channels having different resistance values arranged parallel to the second collection channel, and the supply-side fluid restrictor changes a number of the plurality of branch channels to change the fluid resistance value of the second collection channel.

12. A liquid discharge apparatus comprising the liquid circulation device as claimed in claim 1.

13. A liquid circulation device comprising:

a first liquid discharge head to discharge a liquid;

a first supply channel to supply the liquid to the first liquid discharge head;

a first collection channel to collect the liquid from the first liquid discharge head;

a second liquid discharge head to discharge the liquid and disposed higher than the first liquid discharge head;

a second supply channel to supply the liquid to the second liquid discharge head;

a second collection channel to collect the liquid from the second liquid discharge head;

a supply-side fluid restrictor disposed in the first supply channel to make a fluid resistance value of the first supply channel greater than a fluid resistance value of the second supply channel; and a collection-side fluid restrictor disposed in the second collection channel to make a fluid resistance value of the second collection channel greater than a fluid resistance value of the first collection channel, wherein the supply-side fluid restrictor changes the fluid resistance value of the first supply channel to be higher than the fluid resistance value of the second supply channel, the supply-side fluid restrictor includes a plurality of branch channels having different resistance values arranged parallel to the first supply channel, and the supply-side fluid restrictor changes a number of the plurality of branch channels to change the fluid resistance value of the first supply channel.

14. The liquid circulation device according to claim 13, wherein the supply-side fluid restrictor changes a cross-sectional area of the first supply channel to change the fluid resistance value of the first supply channel.

15. The liquid circulation device according to claim 13, wherein the collection-side fluid restrictor changes the fluid resistance value of the second collection channel to be higher than the fluid resistance value of the first collection channel.

16. The liquid circulation device according to claim 15, wherein the collection-side fluid restrictor changes a cross-sectional area of the second collection channel to change the fluid resistance value of the second collection channel.

17. The liquid circulation device according to claim 15, wherein the collection-side fluid restrictor includes a plurality of branch channels having an identical resistance value arranged parallel to the second collection channel, and the collection-side fluid restrictor changes a number of the plurality of branch channels to change the fluid resistance value of the second collection channel.

18. The Liquid circulation device according to claim 15, wherein the collection-side fluid restrictor includes a plurality of branch channels having different resistance values arranged parallel to the second collection channel, and wherein the supply-side fluid restrictor changes a number of the plurality of branch channels to change the fluid resistance value of the second collection channel.

19. A liquid discharge apparatus comprising the liquid circulation device as claimed in claim 13.

20. A liquid circulation device comprising:

a first liquid discharge head to discharge a liquid;

a first supply channel to supply the liquid to the first liquid discharge head;

a first collection channel to collect the liquid from the first liquid discharge head;

a second liquid discharge head to discharge the liquid and disposed higher than the first liquid discharge head;

a second supply channel to supply the liquid to the second liquid discharge head;

a second collection channel to collect the liquid from the second liquid discharge head;

a supply-side fluid restrictor disposed in the first supply channel to make a fluid resistance value of the first supply channel greater than a fluid resistance value of the second supply channel;

a collection-side fluid restrictor disposed in the second collection channel to make a fluid resistance value of the second collection channel greater than a fluid resistance value of the first collection channel;

a pressurized sub-tank connected to the first liquid discharge head via the first supply channel and connected to the second liquid discharge head via the second supply channel to accommodate the liquid to be supplied to the first liquid discharge head and the second liquid discharge head;

a depressurized sub-tank connected to the first liquid discharge head via the first collection channel and connected to the second liquid discharge head via the second collection channel to accommodate the liquid collected from the first liquid discharge head and the second liquid discharge head, wherein the first liquid discharge head includes a first nozzle face in which a plurality of nozzles is formed to discharge the liquid, the second liquid discharge head includes a second nozzle face in which a plurality of nozzles is formed to discharge the liquid, and a height of the second nozzle face is higher than a height of the first nozzle face;

a plurality of first liquid discharge heads each including the first nozzle face disposed at a same height;

a first pressurized manifold communicating with the plurality of first liquid discharge heads via the first supply channel;

a first depressurized manifold communicating with the plurality of first liquid discharge heads via the first collection channel;

a plurality of second liquid discharge heads each including the second nozzle face disposed at a same height, the height of the second nozzle face being higher than the height of the first nozzle face;

a second pressurized manifold communicating with the plurality of second liquid discharge heads via the second supply channel; and a second depressurized manifold communicating with the plurality of second liquid discharge heads via the second collection channel.

* * * * *